US006786046B2

(12) United States Patent
Wiebe et al.

(10) Patent No.: US 6,786,046 B2
(45) Date of Patent: Sep. 7, 2004

(54) DUAL-MODE NOZZLE ASSEMBLY WITH PASSIVE TIP COOLING

(75) Inventors: David James Wiebe, Orlando, FL (US); David D. North, Palm Beach Gardens, FL (US); William Richard Ryan, Oviedo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 0 days.

(21) Appl. No.: 10/241,352

(22) Filed: Sep. 11, 2002

(65) Prior Publication Data

US 2004/0045296 A1 Mar. 11, 2004

(51) Int. Cl.[7] ..... F23R 3/28
(52) U.S. Cl. ..... 60/737; 60/742
(58) Field of Search ..... 60/737, 740, 742

(56) References Cited

U.S. PATENT DOCUMENTS 4,850,194 A * 7/1989 Fuglistaller et al. ..... 60/737
4,850,196 A 7/1989 Scalzo et al.
5,259,184 A 11/1993 Borkowicz et al.
5,307,635 A 5/1994 Graves et al.
5,361,578 A * 11/1994 Donlan ..... 60/742
5,408,830 A * 4/1995 Lovett ..... 60/737
5,685,139 A 11/1997 Mick et al.

* cited by examiner

*Primary Examiner*—Louis J. Casaregola

(57) ABSTRACT

A flame-holding nozzle for a combustion turbine engine is disclosed. The nozzle includes several elongated sleeves in a substantially concentric arrangement. The sleeves cooperatively provide distinct passageways for fluids to move through the nozzle. The nozzle includes conduits that advantageously direct fluids to designated regions of the nozzle, allowing fuel and cooling fluid to move within the nozzle without becoming commingled. Portions of the nozzle sleeves are also strategically arranged to transmit fluids in a manner that provides substantially-uniform thermal expansion, thereby reducing the need for sliding joints or bellows arrangements.

17 Claims, 3 Drawing Sheets

DUAL-MODE NOZZLE ASSEMBLY WITH PASSIVE TIP COOLING

FIELD OF THE INVENTION

This invention relates generally to the field of fuel nozzles and, more particularly, to a dual-mode flame holding, Up-cooled combustion engine fuel nozzle.

BACKGROUND OF THE INVENTION

Combustion engines are machines that convert chemical energy stored in fuel into mechanical energy useful for generating electricity, producing thrust, or otherwise doing work. These engines typically include several cooperative sections that contribute in some way to this energy conversion process. In gas turbine engines, air discharged from a compressor section and fuel introduced from a fuel supply are mixed together and burned in a combustion section. The products of combustion are harnessed and directed through a turbine section, where they expand and turn a central rotor. The rotor produces shaft horsepower or torque; this output shaft may, in turn, be linked to devices such as an electric generator to produce electricity.

As the need for electricity rises, so to do the performance demands made upon industrial turbine combustion engines. Increasingly, these engines are expected to operate at increased levels of efficiency, while producing only minimal amounts of unwanted emissions. Various approaches have been undertaken to help achieve these results.

One approach has been to utilize multiple single-mode nozzles arranged in discrete groups to form a so-called "dry, low-$NO_x$" (DLN) combustor. DLN combustors typically provide lowered amounts of unwanted emissions by lowering the burning temperature and by premixing fuel and air providing independent flows of fuel to two or more discrete groups or "stages" of combustors, with each stage contributing in a different manner to the overall combustion process. Two common stages found in DLN arrangements are the "pilot" and "main" stages. Quite often, the pilot stage is a "diffusion" nozzle capable of holding a flame. Diffusion-type nozzles are quite stable, but they inherently include fuel-rich regions which provide a source of combustion hot spots that lead to the formation of unwanted NOx emissions. To keep these NOx emissions at a minimum, typically only one diffusion nozzle is used in a given combustor. The main stage nozzles operate in a "premix" mode, producing a mixture of fuel and air that bums through interaction with other flames, such as the fuel-rich flame produced by the pilot stage. This arrangement is stable and produces relatively-low NOx emissions, when compared to earlier approaches. However, the diffusion-type pilot nozzle produces localized regions of high temperature or "hot spots" and remains a source of unwanted NOx emissions, making this approach unsuitable for some settings.

In an attempt to reduce NOx emissions even further, various attempts to make DLN combustors having pilot nozzles with a reduced reliance on diffusion-type flames have been made. In some cases, these efforts have focused on nozzles capable of operating in both diffusion and "premix" modes. Efforts to produce such a nozzle have met with difficulty. This type of nozzle must not only be able to produce a controlled stream of mixed fuel and air, it must also be able to dispense fuel for operation in a diffusion-mode and provide tip cooling to avoid melting as combustion temperatures rise to meet increased demands for power output. Nozzles attempting to provide these characteristics have succeeded to varying degrees. For a variety of reasons, however, the practical difficulties imposed by meeting these requirements simultaneously has resulted in nozzles that are prone to leaks, are not reliable, and which may actually reduce efficiency due to losses generated by a large number of components.

Accordingly, there exists a need for a dual-mode, flame-stable nozzle that provides tip cooling and selectively dispense diffusion fuel or a mixture of fuel and air in a simplified manner. The nozzle should transmit cooling air passively, through a dedicated passage that eliminates the need for complex valve arrangements. The nozzle should also include discrete fluid-guiding conduits that are sealed in a leak-resistant manner with reduced reliance upon sliding joints and bellows arrangements.

SUMMARY OF THE INVENTION

The instant invention is a dual-mode, flame-holding nozzle for a gas turbine combustion engine that provides passive tip cooling and selective dispersion of diffusion fuel or mixed fuel and air. The nozzle includes several elongated sleeves that cooperatively form discrete passageways adapted to transmit fluids through the nozzle. The nozzle includes conduits that allow fuel and cooling air to reach designated fuel and cooling passageways without mixing. This arrangement advantageously ensures that air used to cool the nozzle does not become flammable, thereby reducing the chances of unwanted flashback occurrences. Portions of the nozzle sleeves are also strategically arranged to transmit fluids in a manner that provides substantially-uniform thermal expansion, thereby reducing the need for sliding joints and/or bellows arrangements.

Accordingly, it is an object of the present invention to provide a dual-mode combustor nozzle having passive tip cooling and controlled flameholding capabilities.

It is another object of the present invention to provide a dual-mode combustor nozzle that includes a dedicated cooling fluid passageway that operates without complex valve or manifold arrangements.

It is another object of the present invention to provide a dual-mode combustor nozzle that includes discrete fluid-guiding regions that are sealed with a reduced need for sliding joints or bellows arrangements.

Other objects and advantages of this invention will become apparent from the following description taken in conjunction with the accompanying drawings wherein are set forth, by way of illustration and example, certain embodiments of this invention. The drawings constitute part of this specification and include exemplary embodiments of the present invention and illustrate various objects and features thereof.

DETAILED DESCRIPTION OF THE INVENTION

Figure 1:
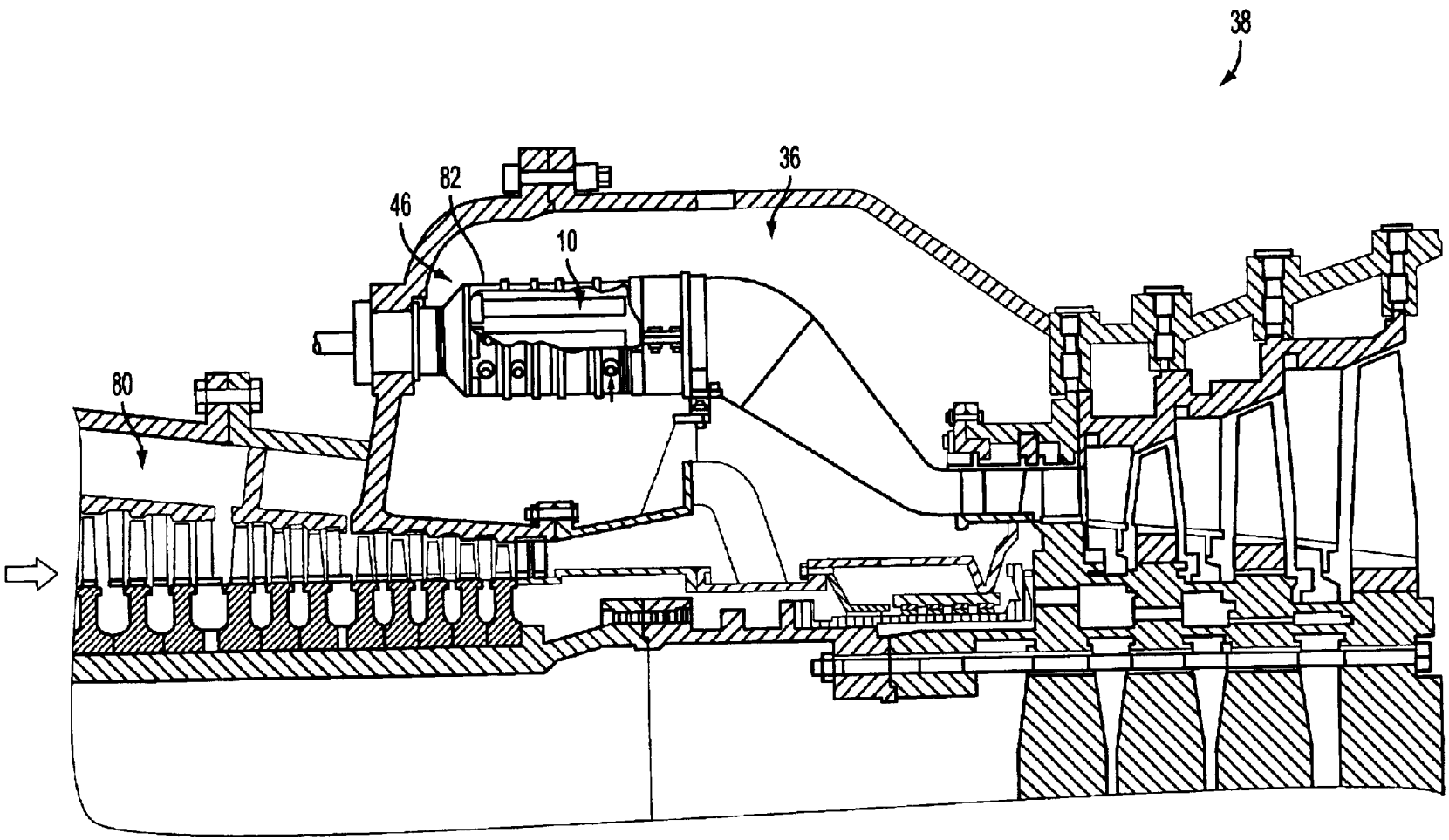
FIG. 1 is a side elevation of a combustion engine employing the nozzle of the present invention.

Reference is now made in general to the Figures, wherein the nozzle 10 of the present invention is shown. As shown in FIG. 1, the nozzle 10 of the present invention is especially suited for use in a combustion system 36 using nozzles that operate in a dual-mode arrangement, but could have application as a single-mode nozzle, as well. By way of overview, and with additional reference to FIG. 2, the nozzle 10 resembles an elongated cylinder having several substantially-concentric tubes 12, 14, 15, 16, 18 that cooperatively form a collection of annular chambers 20, 22, 23, 24, 26 which facilitate controlled flow of fluids through the nozzle. The nozzle 10 is characterized by a first end 40 and an opposite second end 42, with fluids flowing generally from the first end to the second end during operation. The nozzle 10 also includes conduit groups 28, 30 that advantageously allow fuel 32 and tip cooling air 34 to reach designated passageways within the nozzle. More particularly, the first conduit group 28 allows fuel 32 to move from the second passageway 22 Into the first passageway 20, to interact with air 52 located therein. The second conduit group 30 beneficially allows cooling air 34 to reach the third passageway 24 from a location radially outward of the fuel-containing second passageway 22, without allowing fuel 32 to contaminate the cooling air. Third passageway exits 60 allow cooling air 34 to leave the third passageway exits 60 and cool the nozzle second end 42. A supplemental passageway 23 disposed between the second and third passageways 22,24 supplies supplemental diffusion fuel 74 to the nozzle Up 42. The conditions within an associated combustor 46 at the nozzle second end 42 ensure the flame is maintained/self-stable. As is known in the art, for example, when operating in a diffusion mode, fuel is supplied through diffusion holes 61 at a velocity range conducive to stable conditions. In this mode, the fuel injected through the holes 61 mixes with the air passing through the annulus 20 combustion immediately downstream of nozzle tip 42. The outer shroud 12 may diverge outward, as it extends downstream beyond tip 42, forming a cone that aides in stabilizing the flame. When operating in the pre-mix mode, fuel is injected through holes 58 into the air stream 52. This fuel/air mixture flows through passageway 20 and enters the flame front immediately downstream of the nozzle tip 42. Adequate velocity is maintained in passageway 20 to prevent the flame from proceeding upstream. The nozzle 10 will now be described in further detail.

In one embodiment, the nozzle 10 of the present Invention is especially suited for use as a flame-holding, dual-mode nozzle capable of operating in a premix mode and a diffusion mode. Premix fuel 32 travels from a source of fuel (not shown) through apertures 50 at the upstream end 40 of the nozzle 10 and enters a nozzle second passageway 22. The fuel 32 flows through the second passageway 22 and travels into the first passageway 20, where it forms a flammable mixture with air 52 located therein. The flammable mixture flows toward the nozzle second end 42; combustion may be initiated by an Igniter 76 that is positioned in a nozzle inner passageway 26 or located remotely. If the inner passageway 26 is not used to hold an igniter 76, the inner passageway may be plugged or adapted to transmit a fluid to the nozzle tip 42. As noted above, the nozzle also contains a supplemental passageway 23 through which supplemental fuel 74 may be transmitted to the nozzle second end 42 to permit diffusion-style combustion. Tip cooling air 34 passes through the third passageway and prevents tip melting, as described below.

Figure 2:
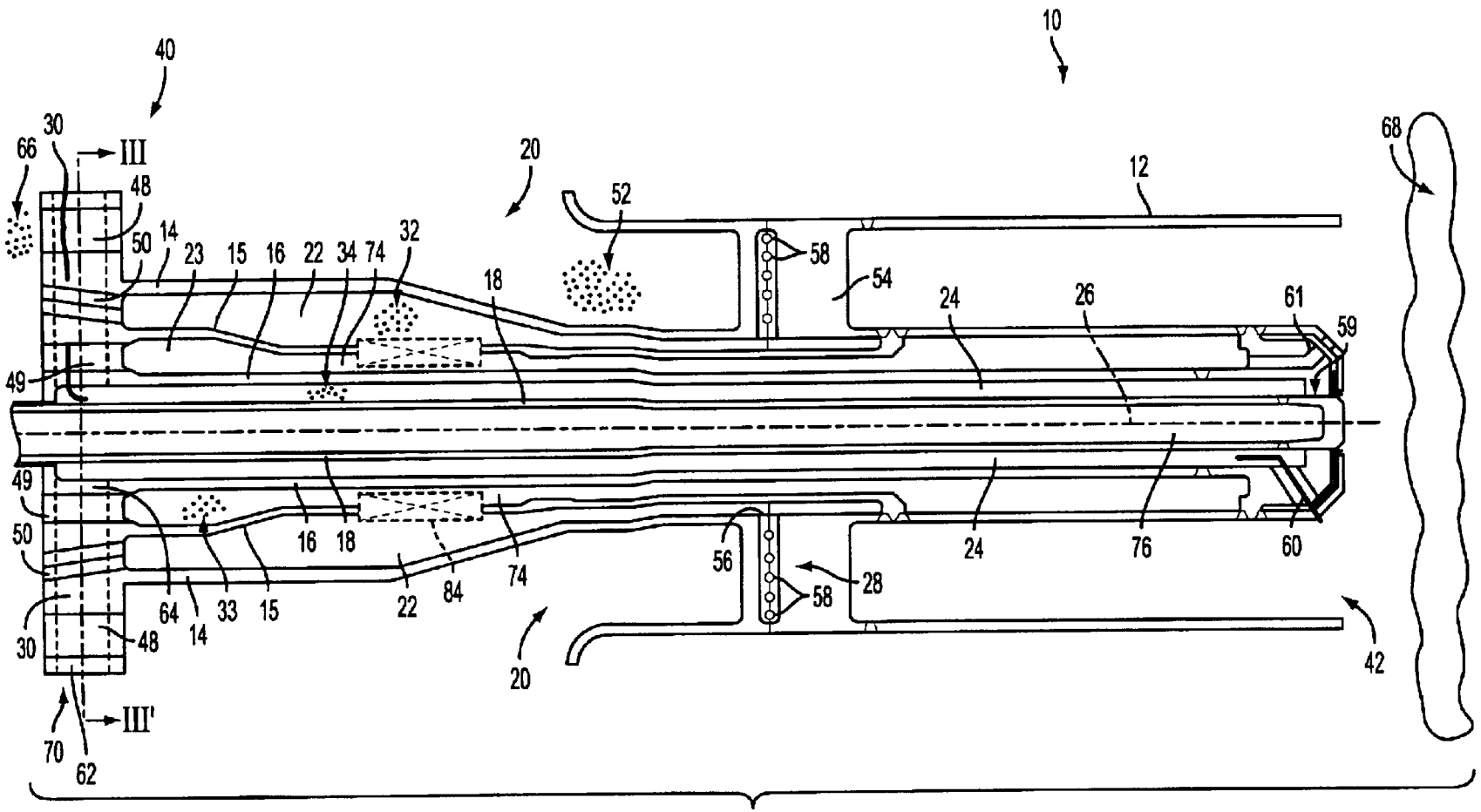
FIG. 2 is a side sectional view of the nozzle of the present invention.
Figure 3:
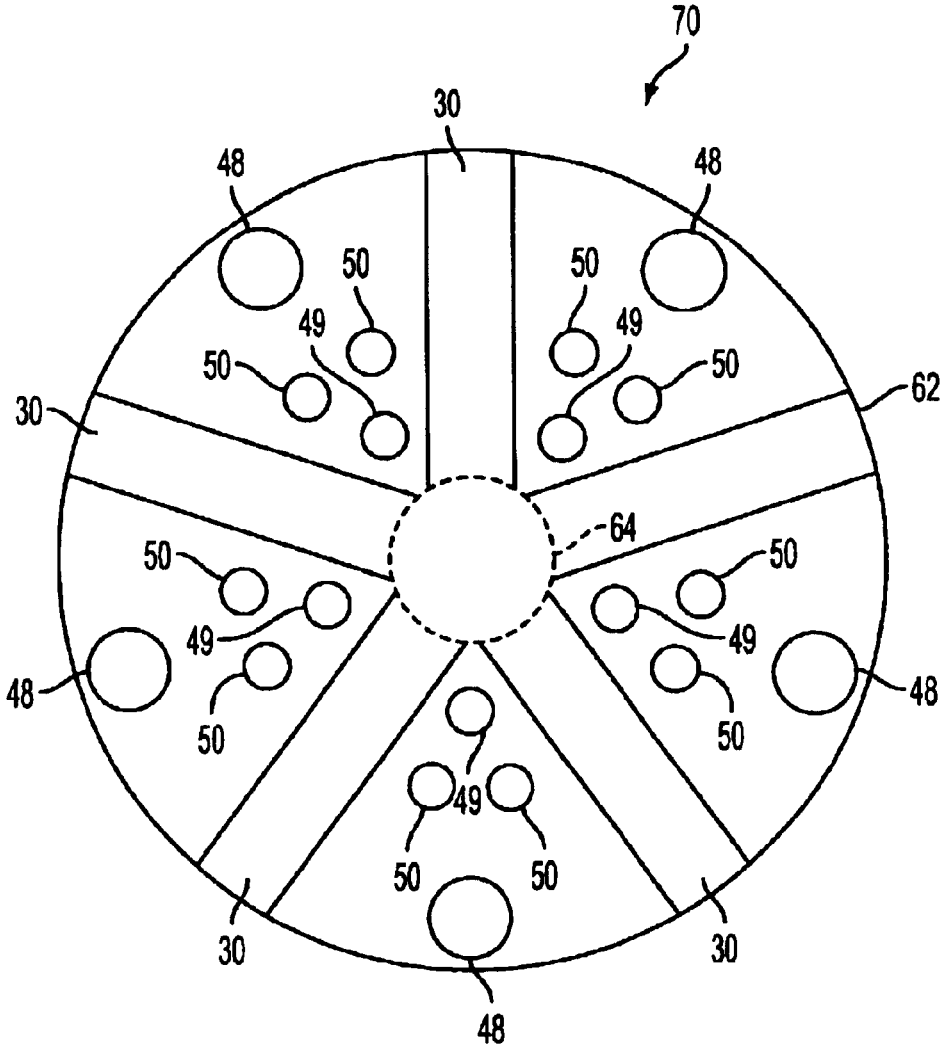
FIG. 3 is an end view of the fluid transfer hub shown in FIG. 2, taken along cutting line III–III' of FIG. 2.

With particular reference to FIGS. 2 and 3, the nozzle 10 includes a fluid supply hub 70 includes three groups of apertures 48, 49, and 50 that allow premix air 52 and premix fuel 32, and supplemental diffusion fuel 74 respectively, to pass through the flange and enter corresponding passageways, or chambers, formed by the nozzle sleeves 14.15,16, and 18. More particularly, the first set of apertures 48 facilitates entry of premix air 52 into the nozzle first passageway 20. Similarly, the second set of apertures 50 allows premix fuel 32 to enter the nozzle second passageway 22, and the set of supplemental apertures 49 allows diffusion fuel to reach the supplemental passageway 23.

With continued reference to FIGS. 2 and 3, conduits 28,30 beneficially allow premix fuel 32 and cooling air 34, respectively, to flow between portions of the nozzle 10 without becoming co-mingled. The first group of conduits 28 includes fuel injection members 54 that are each characterized by an entrance 56 in fluid communication with the second passageway 22 and an exit 58 in fluid communication with the first passageway 20. With continued reference to FIG. 2, the fuel injection members 54 are hollow and include a group of exit holes 58. With this arrangement the fuel injection members 54 transmit premix fuel 32 into the first passageway 20, where it mixes with premix air 52 and creates a flammable mixture of fuel and air. To increase the uniformity of fuel and air mixing, the fuel injection members 54 may be adapted to increase the turbulence within the first passageway 20 by, for example, having a substantially-airfoil-shaped cross-section. Other mixing or turbulence-increasing elements including, discrete swirler vanes or other suitable components, may also be provided as desired.

It is noted that the first set of conduits 28 need not include fuel injection members 54, and may take a variety of forms that permit fuel to travel from the second passageway 22 to the first passageway 20. For example, premix fuel 32 fuel may be dispersed directly through the first sleeve 14. It is further noted that the fuel 32 may exit the second passageway 22 from a variety of axially-different locations. It Is also noted that the outer wall 12 is not required for operation; the first passageway 20 may be bounded by the first sleeve 14 and a supplemental sleeve or partition, such as the combustor wall 82 or other suitable boundary, as seen in FIG. 1.

As noted above, the second group of conduits 30 provide dedicated paths through which air 34 reaches the third passageway 24. As will be described in more detail below, the air 34 in the third passage acts as cooling air, flowing downstream and through third passageway exits 60 to cool the nozzle tip or second end 42.

Each of the conduits 30 in the second conduit group includes an entrance 62 in fluid communication with a source of cooling air (such as a compressor 80 coupled with the associated combustion turbine engine 38, seen in FIG. 1) and an opposite exit 64 in fluid communication with the third passageway 24. In one embodiment, the second conduit entrances 62 are in fluid communication with compressor discharge air 66, and the second group of conduits 30 directs a portion of the compressor discharge air into the third passageway 24 to, as noted above, cool the nozzle second end 42.

With particular reference to FIG. 3, each of the cooling air conduits 30 is oriented radially within the fluid supply hub 70. With continued reference to FIG. 3, the cooling fluid conduits 30 lie between the premix air, supplemental fuel, and premix fuel apertures 48, 49, and 50, which extend longitudinally through the fluid supply hub 70. In keeping with the objects of the invention, this arrangement advantageously allows the entrances 62 of the cooling fluid conduits 30 to be located radially-outboard of the fuel 32 and the cooling fluid conduit exits 64 to be located radially-inboard of the premix fuel. As a result, the cooling fluid conduit entrances 62 are located upstream of the locations where fuel 32 joins the compressor discharge air 66. This arrangement advantageously allows one source of air 66 to provide air for several purposes, while safely ensuring that the air 34 used for cooling is fuel-free and not flammable.

As seen in FIG. 2, sliding interface 59 permits relative motion at the second end of the nozzle 42, thereby accommodating thermal growth differences during operation. With this arrangement, air, and not fuel, flows within passageway 34. This advantageously ensures that fluid which may emanate from the interface 59 is not flammable.

It Is noted that the cooling fluid conduits 30 need not be radially arranged; any suitable orientation that allows the cooling air 34 to enter the third passageway 24 from a location upstream of the premix fuel 32 would suffice. Radial arrangement of the cooling fluid conduits 30 does, however, provide enhanced manufacturability. It is also noted that the cooling fluid conduits 30 need not be located in a fluid supply hub 70; other locations may be used as desired. For example, the cooling fluid conduits 30 may extend through a component that supports the nozzle 10, such as a mounting flange (not shown). It is also noted that compressor discharge air 66 substantially surrounds the nozzle first end 40, and that such air may enter the first passageway by travelling around the nozzle first end and flowing between the outer wall 12 and first sleeve 14, thereby eliminating the need for the first group of apertures 48.

With continued reference to FIG. 2, the cooling fluid passageway exits 60 are in fluid communication with the first passageway 20, and a pressure drop across the first passageway helps move the flow of cooling air 34 through the third passageway 24 and exit 60. The pressure difference also beneficially prevents the air fuel mixture from entering passage 24. With this arrangement, the nozzle 10 of the present invention provides a passive tip cooling system that employs a dedicated, air-only cooling fluid, eliminating the need for flows of purge fluid or fuel-blocking members.

It is noted that while the nozzle 10 of the present invention has been described as diverting a portion of the compressor discharge air 66 into the third passageway 24 to provide cooling air 34, other arrangements may be used. For example, the entrances 62 of the cooling fluid conduits 30 may be in fluid connection with other sources of cooling air, including a cooling air manifold (not shown). It is also noted that cooling air 34 may be motivated through the third passageway 24 by a pump (not shown) or other suitable flow-inducing components.

During operation, the first and second sleeves 14,16 are each exposed to compressor discharge air 66 and premix fuel 32. As a result, the thermal expansion exhibited by the first sleeve 14 is substantially, if not identically, the same as the thermal expansion exhibited by the second sleeve 16. With this arrangement, the first sleeve 14 may advantageously be connected to the second sleeve 16 in a rigid manner, without a flexible connection or slip-fit arrangement. This advantageously makes the nozzle 10 more reliable, increases the nozzle life span, and makes the nozzle less likely to leak. The supplemental sleeve 15 is exposed only to fuel and expands differently than the first and second sleeves 14,16. A bellows element 84 disposed in the supplemental sleeve accommodates thermal expansion differences between the sleeves without stressing the nozzle.

It is to be understood that while certain forms of the invention have been illustrated and described, it is not to be limited to the specific forms or arrangement of parts herein described and shown. It will be apparent to those skilled in the art that various, including modifications, rearrangements and substitutions, may be made without departing from the scope of this invention and the invention is not to be considered limited to what is shown in the drawings and described in the specification. The scope if the invention is defined by the claims appended hereto.

What is claimed is:

1. A dual-mode fuel nozzle for a combustion engine, said nozzle comprising:

an elongated first sleeve characterized by an upstream end and an opposite downstream end;

a supplemental sleeve disposed radially inward of said first sleeve, said first and supplemental sleeves defining a first fuel passageway therebetween, said first fuel passageway including an inlet and an exit, said inlet being adapted for fluid communication with a source of fuel;

a second sleeve disposed radially inward of said supplemental sleeve said supplemental and second sleeves defining a supplemental fuel passageway therebetween, said supplemental fuel passageway including an inlet and an exit, said an inlet being adapted for fluid communication with a source of fuel;

a third sleeve disposed radially inward of said second sleeve, said second and third sleeves defining a cooling fluid passageway therebetween, said cooling fluid passageway having an inlet and an exit; and a cooling fluid conduit adapted to fluidly connect said cooling fluid passageway with a source of cooling fluid, said conduit having a conduit entrance located upstream of said fuel passageway exit and a conduit exit in fluid communication with said cooling fluid passageway inlet, whereby said cooling fluid conduit, said cooling fluid passageway, and said fuel passageways cooperatively ensure that cooling fluid passing through said cooling fluid passageway exit is substantially fuel-free during operation.

2. The dual-mode fuel nozzle of claim 1, wherein said cooling fluid is air discharged from a compressor operatively associated with said combustion engine.

3. The dual-mode fuel nozzle of claim 1, wherein said first sleeve cooperatively forms an outer passageway with an outer boundary member spaced radially outward from said first sleeve, said outer passageway being in fluid communication with said fuel passageway exit, said outer passageway including an upstream entrance and a downstream exit, said entrance being adapted for fluid communication with a source of air.

4. The dual-mode fuel nozzle of claim 3, wherein said outer boundary member is an outer wall disposed around a portion of said first sleeve.

5. The dual-mode fuel nozzle of claim 3, further including a mixing member disposed within said outer passageway, said mixing member being adapted to at least partially produce a pressure drop.

6. The dual-mode fuel nozzle of claim 3, wherein said cooling fluid is motivated through said cooling fluid passageway substantially by a pressure drop between said cooling fluid conduit entrance and said cooling fluid exit.

7. The dual-mode fuel nozzle of claim 6, wherein said cooling fluid includes air discharged from a compressor operatively associated with said combustion engine.

8. The dual-mode fuel nozzle of claim 3, wherein said cooling fluid is motivated by a pressure drop at least partially induced by a mixing member disposed within said outer passageway.

9. The dual-mode fuel nozzle of claim 3, wherein said cooling fluid is motivated by a pressure drop at least partially induced by orientation of an outer wall with respect to said first sleeve.

10. The dual-mode fuel nozzle of claim 9, wherein said pressure drop is at least partially induced by a mixing member disposed within said outer passageway.

11. The dual-mode fuel nozzle of claim 3, wherein:

said first sleeve and said second sleeve are each characterized by a first surface and an opposite second surface, each of said first surfaces being arranged for contact with a first fluid having a first temperature and each of said second surfaces being arranged for contact with a second fluid having a second temperature, wherein said contact produces substantially-equal thermal expansion in said first and second sleeves.

12. The dual-mode fuel nozzle of claim 11, wherein:

said first and second sleeves are joined together in a rigid relationship, whereby said substantially-equal thermal expansion facilitates said rigid relationship.

13. The dual-mode fuel nozzle of claim 3 further comprising a bellows member disposed within said supplemental sleeve.

14. The dual-mode fuel nozzle of claim 3 further comprising a mounting flange adjacent an upstream end of said nozzle, said cooling fluid conduit being disposed in said mounting flange.

15. The dual-mode fuel nozzle of claim 14 wherein said cooling fluid conduit is oriented in a substantially-radial relationship with respect to a longitudinal axis of said nozzle.

16. The dual-mode fuel nozzle of claim 3 further comprising a fluid transfer member adjacent an upstream end of said nozzle, said cooling fluid conduit being disposed in said fluid transfer member.

17. The dual-mode fuel nozzle of claim 16 wherein said cooling fluid conduit is oriented in a substantially-radial relationship with respect to a longitudinal axis of said nozzle.

* * * * *